United States Patent [19]

Murakami et al.

[11] 4,365,886

[45] Dec. 28, 1982

[54] ELECTROSTATIC COPYING APPARATUS WITH AN ATTACHMENT TO ENABLE TWO-SIDED COPYING

[75] Inventors: Reiji Murakami; Shunichi Nakajima, both of Yokohama, Japan

[73] Assignee: Tokyo Shibaura Denki Kabushiki Kaisha, Kawasaki, Japan

[21] Appl. No.: 240,382

[22] Filed: Mar. 4, 1981

[30] Foreign Application Priority Data

Mar. 5, 1980 [JP] Japan ..... 55-27634

[51] Int. Cl.[3] ..... G03G 15/00

[52] U.S. Cl. ..... 355/3 SH; 271/3.1; 355/23

[58] Field of Search ..... 355/3 SH, 14 SH, 23, 355/24, 26; 271/3.1, 4, 9, 65, 186

[56] References Cited

U.S. PATENT DOCUMENTS 3,999,852 12/1976 Katayama et al. ..... 355/24 X 4,279,504 7/1981 Brown et al. ..... 355/3 SH

*Primary Examiner*—R. L. Moses

*Attorney, Agent, or Firm*—Cushman, Darby & Cushman

[57] ABSTRACT

An electrostatic copying apparatus includes a main copying device for one-sided copying and an auxiliary copying device removably coupled with the main device for double-sided copying. The auxiliary device includes a director gate for selectively leading a recording paper, having been copied on one side and having been transferred from the main device through a paper exhaust opening thereof, to first and second auxiliary paper exhaust trays. The paper in the second auxiliary paper exhaust tray is again supplied to the main device through a paper supplying opening of the main copying device to enable the other side to be copied.

8 Claims, 5 Drawing Figures

ELECTROSTATIC COPYING APPARATUS WITH AN ATTACHMENT TO ENABLE TWO-SIDED COPYING

BACKGROUND OF THE INVENTION

The present invention relates to an electrostatic copying apparatus which can automatically transfer images onto both sides of a recording paper.

One known copying apparatus of this type has an automatic double side copying mechanism assembled into a main body of the copying apparatus. A problem exists, however that the size of the overall copying apparatus is large; a large area of the apparatus is occupied by the automatic copying mechanism even when double-sided copying is not needed for a long time. Therefore, it is inconvenient to carry or move the copying apparatus.

SUMMARY OF THE INVENTION

Accordingly, an object of the invention is to provide an electrostatic copying apparatus which can automatically transfer images on both sides of a recording paper, of which the size can be made small when no double-sided copying is performed for a long time, and which is easily carried or moved.

DETAILED DESCRIPTION OF THE PREFERRED EMBODIMENT

An embodiment of an electrostatic copying apparatus according to the present invention will be described referring to the accompanying drawings.

Figure 1:
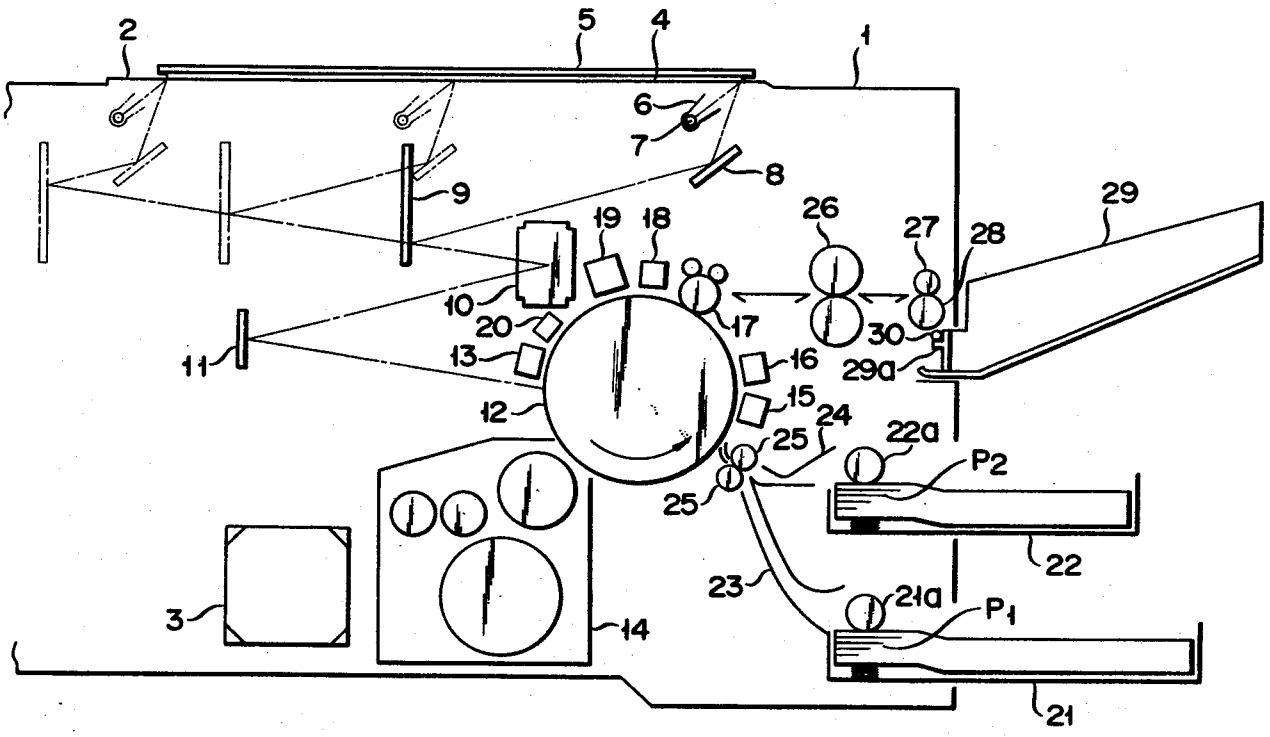
FIG. 1 is a schematic view of an arrangement of a main body of an electrostatic copying apparatus which is an embodiment of the invention.

In FIG. 1, a box-like housing designated by reference numeral 1 is provided on the upper surface with a table 2 on which an object 4 to be copied, for example, a document, is placed. A cover 5 is mounted to the document table 2 so that it can cover the document 4 on the table 2. Provided within the housing 1, a lamp 7 with a reflecting cover 6 for illuminating the document 4 is driven by a motor 3 to be horizontally movable. The light beams reflected from the document 4 are successively reflected by first and second mirrors 8 and 9 moving in synchronism with the lamp 7, further by a mirror lens 10 fixed within the housing 1 and a third mirror 11, and then is incident onto a light sensitive means or photoconductive drum 12 to finally form an image of the document 4 on the light sensitive drum 12. The light sensitive drum 12 rotatable provided in the housing 1 is rotated in a direction of an arrow by the motor 3. Disposed around the light sensitive drum 12 are a charger 13, a developer 14, a transfer charger 15, separation charger 16, a turn roller 17, a charge remover 18, a cleaner 19 and an erasing lamp 20 in this order in the rotatory direction of the drum 12. One side wall of the housing 1 has two openings vertically spaced. Cassettes 21 and 22 containing stacked recording papers P1 and P2 with different sizes are removably inserted into those openings, respectively. Rollers 21*a* and 22*a*, rotatably disposed above the feed cassettes 21 and 22, rotate in contact with the uppermost recording papers contained in the cassettes to take the recording paper out of the cassettes, respectively. The recording paper taken out of either of the cassette 21 or 22 is guided by a corresponding guide plate 23 or 24, and is introduced onto the light sensitive drum 12 by a pinch roller 25 disposed between the developer 14 and the transfer charger 15. The recording paper brought onto the drum 12 in this way, as the drum 12 rotates, is led to the transfer charger where an image is transferred on the surface of the recording paper which faces the surface of the drum 12. Then, the image transferred paper passes the separation charger 16 and the turn roller 17, and fixed by the device 26. The fixed recording paper is transferred by a pair of feed rollers 27 and 28 into a tray 29 which is inserted in an opening of the side wall of the housing 1. For setting or removing the tray 29 in or from the housing, the tray 29 is made to engage or disengage at an engaging part 29*a* with or from a support rod horizontally provided in the housing 1.

Figure 2:
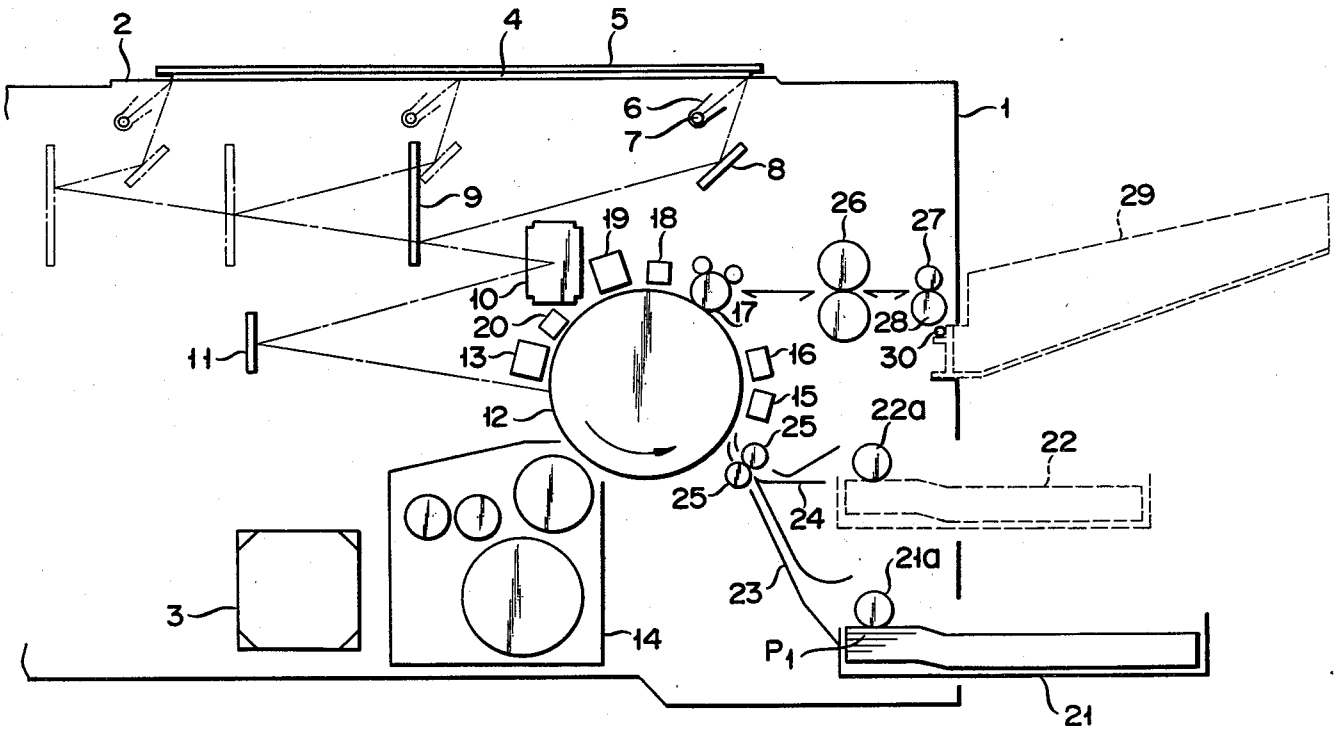
FIG. 2 is a view of the copying apparatus of FIG. 1 when an upper cassette and a tray are removed from the main body of the copying machine.
Figure 3:
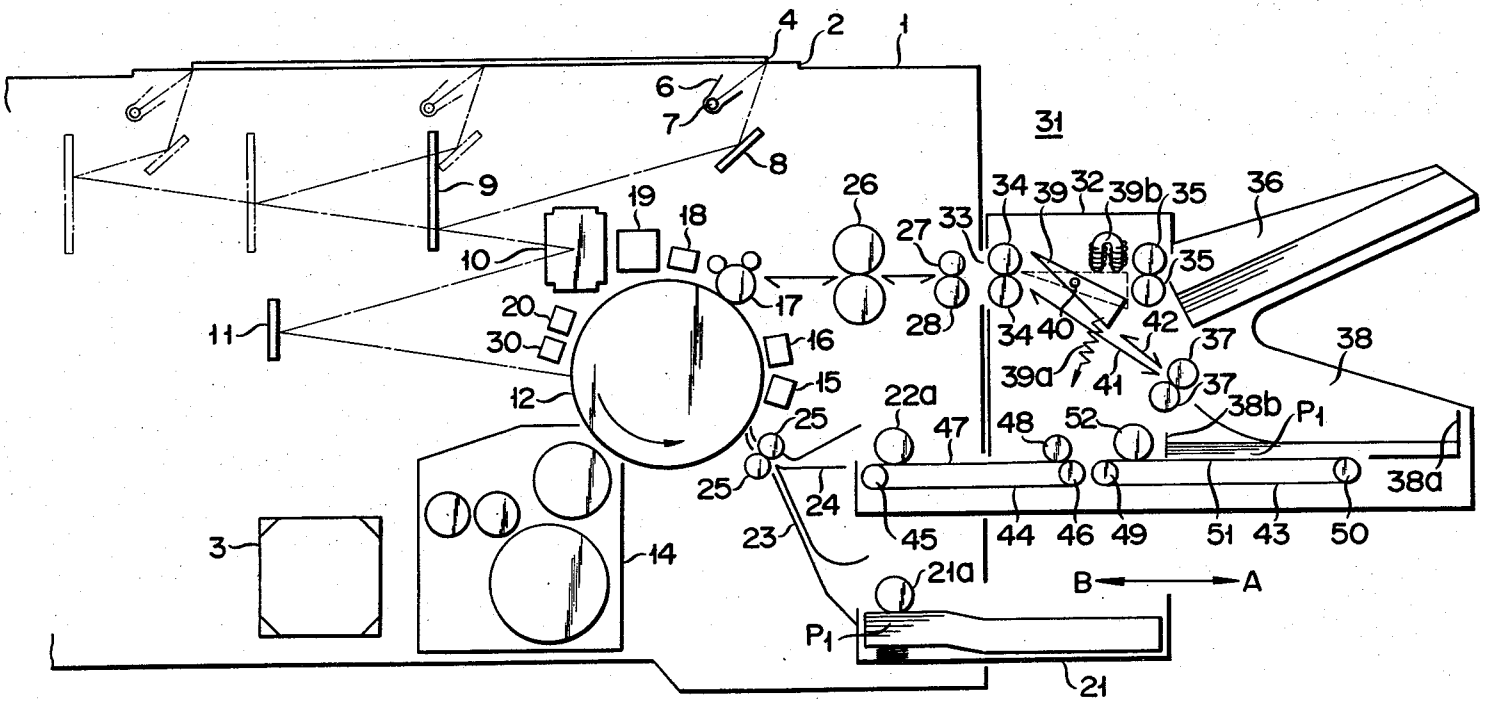
FIG. 3 is a view of the copying apparatus when the main body of the copying apparatus is combined with an auxiliary copying device.
Figure 4:
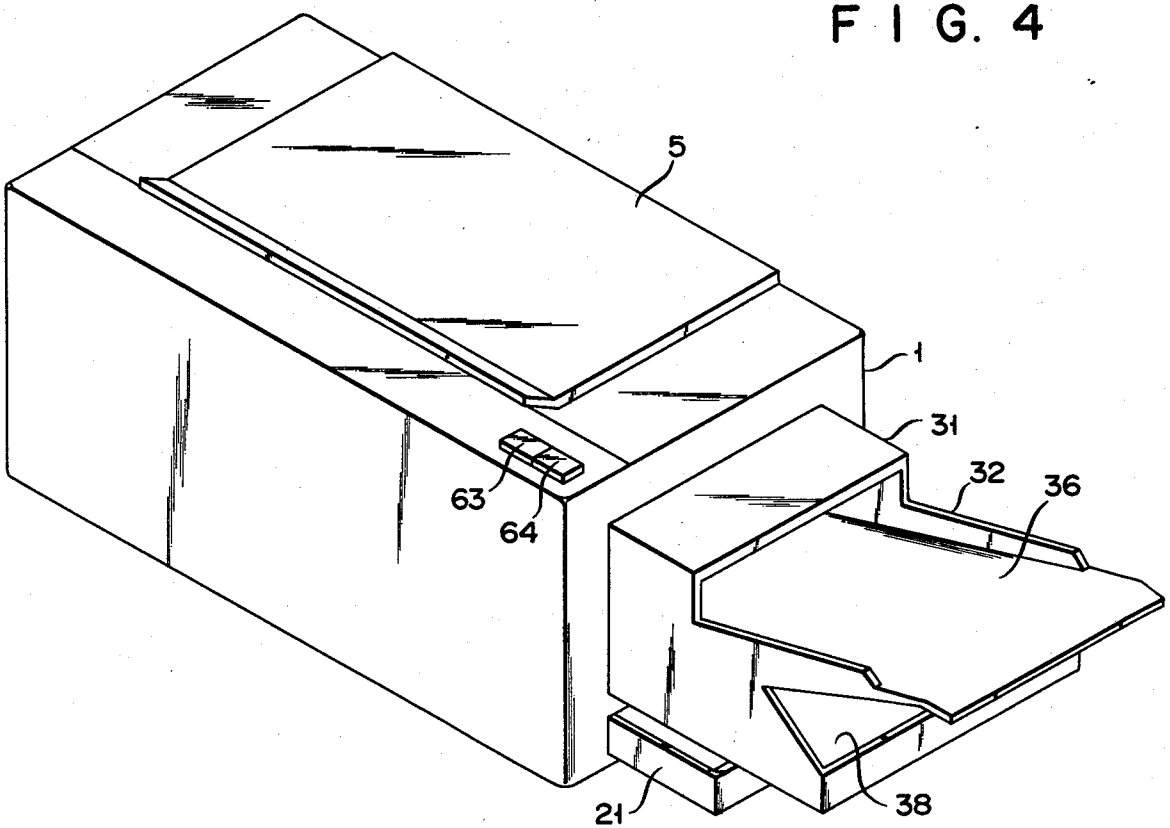
FIG. 4 perspectively illustrates an external view of the electrostatic copying apparatus according to the invention.

The electrostatic copying apparatus body thus constructed is of the well known type and effects a normal single-sided copying operation. For double-sided copying by the main body, the upper cassette 22 and the tray 29 are removed from the housing 1, as shown in FIG. 2. Following this, an auxiliary copying device 31 is attached to the side wall of the housing 1, as shown in FIGS. 3 and 4. The auxiliary copying device 31 is provided with a housing 32. The housing 32 has an entrance opening 33 at the side wall confronting the side wall of the housing 1 of the main body of the copying apparatus. The opening 33 of the auxiliary copying device 31 is aligned with the opening for accepting the tray 29. A pair of transfer rollers 34 are provided in the vicinity of the entrance opening 33 in the auxiliary housing 32. Another pair of transfer rollers 35 and a first auxiliary tray 36 are successively provided downstream from the transfer roller pair 34. The feed rollers 27 and 28, the transfer roller 34, and the transfer roller 35 are disposed on the same level to allow the recording paper to be transferred to the auxiliary tray 36 located downstream therefrom. Yet another pair of transfer rollers 37 are disposed below the roller pair 35 at a given distance therebetween. A second auxiliary tray 38 is disposed downwardly and rearwardly from the feed roller pair 37. The tray 38 is provided with a rear end wall 38*a* which contacts with the recording paper coming through the roller pair 37 to set it in the tray 38. A director gate 39 rotatable about a fulcrum 40 is disposed between the roller pair 34 in the vicinity of the entrance of the housing 32 and the roller pair 35 provided upstream from the first tray 36. The director gate 39 with a triangle cross section is normally held at a position as indicated by a solid line in FIG. 3, by means of a tension spring 39*a*. When the director gate 39 is located at this position, the light sensitive drum 12 transfers an image on one of the faces of the recording paper, and the image transferred recording paper is transferred through the feed rollers 27 and 28 and the paper transfer rollers 34 to the gate 39. The gate 39 directs the recording paper bearing the transferred image toward the roller pair 37 which in turn introduces it to the second auxiliary tray 38. When a print button to be given later is depressed, the turn gate 39 is attracted to a position as indicated by a broken line by a solenoid 39*b* energized to rotate the gate 39 against the tension spring 39*a*. At this position of the director gate 39, the recording paper P1 bearing the transferred image on the one side and transferred to the gate 39 is allowed to be transferred through the gate 39 and the transfer roller pair 35 to the first auxiliary tray 36. A pair of guide plates 41 and 42 confronting each other at a given space therebetween are disposed between the transfer roller pair 34 and the transfer roller pair 37 so that the recording sheet P1 may smoothly be transferred between them.

First and second transfer paths 43 and 44 are coupled with the front side of the second auxiliary tray 38. The first transfer path 43 is defined by an endless belt 51 wound at a tension around a couple of rollers 49 and 50 which are horizontally separated each other. The second transfer path 44 is defined by an endless belt 47 wound at a tension around a couple of rollers 45 and 46 which are separated each other at a given distance and in the same horizontal plane as the rollers 49 and 50. When the auxiliary copying device 31 is coupled with the main body of the copying apparatus, the leading end of the second belt 47 is inserted into the housing 1 of the main body to be substantially flush at the upper surface with the second transfer roller 22*a* of the main body of the copying apparatus.

Figure 5:
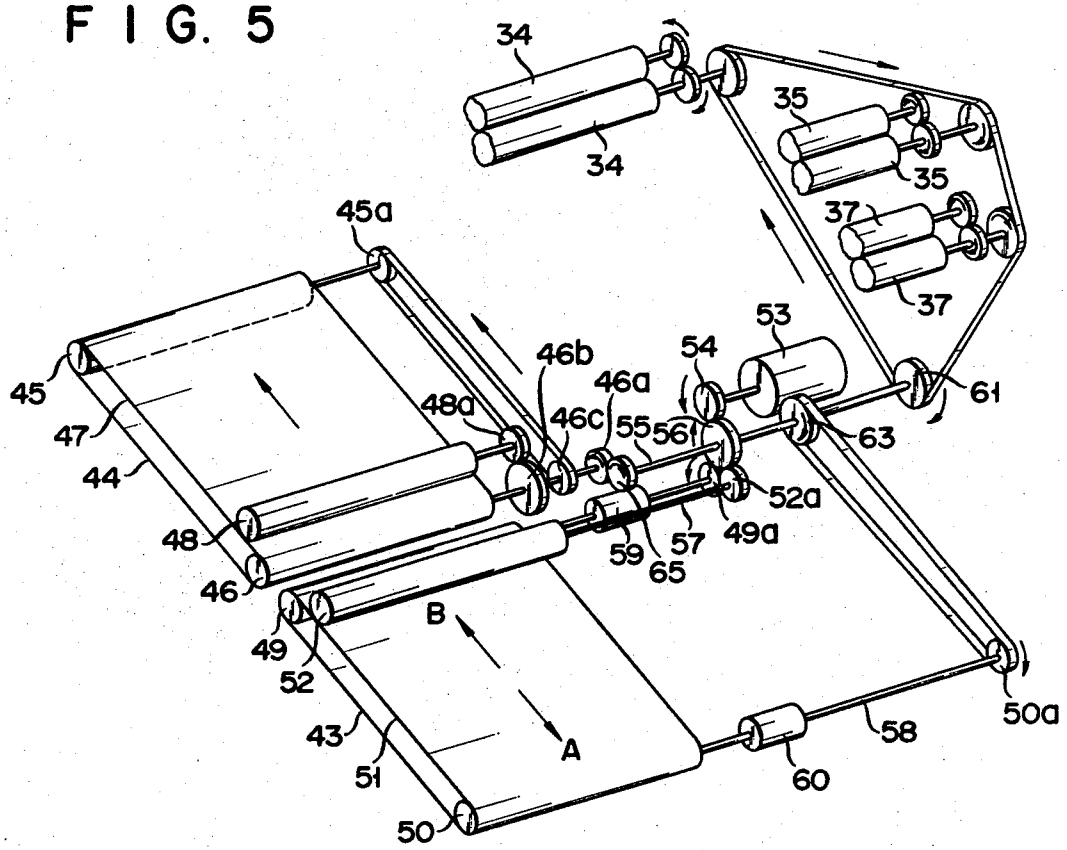
FIG. 5 is a perspective view of a drive mechanism of the auxiliary copying device.

A drive mechanism for the auxiliary copying device 31 with the above-mentioned construction will be described referring to FIG. 5.

A gear 54 is fixed to a rotation shaft of a motor 53 installed in the auxiliary housing 32. The gear 54 is in mesh with an intermediate gear 56 fixed to the mid portion of an intermediate shaft 55 rotatably supported in the housing 32. A gear 65 is provided near one end of the intermediate shaft 55, while sprockets 61 and 63 near the other end of the intermediate shaft 55.

The gear 56 is in mesh with a gear 49*a* coaxially connected to the drive roller 49 and a gear 52*a* coaxially connected to the transfer roller 52. A clutch 59 provided between the drive roller 49 and the gear 49*a* transmits the rotation force of the gear 49*a* to the roller 49 or interrupts the transmission of the rotation force. With the arrangement as mentioned above, the counterclockwise rotation of the drive gear 54 of the motor 53 causes the transfer roller 52 to rotate counterclockwise and the drive roller 49 to stop the rotation or to rotate counterclockwise.

The sprocket 63 is coupled with a sprocket 50*a* coaxially coupled with the driver roller 50, by means of a chain. The clockwise rotation of the sprocket 63 causes the roller 50 to rotate clockwise. Another clutch 60 provided between the roller 50 and the sprocket 50*a* selectively transmits the rotation force of the sprocket 50*a* to the roller 50.

The gear 65 is in mesh with a gear 46*a* coaxially coupled with the drive roller 46, which is one of the drive rollers of the second transfer path 44, by means of a shaft. Coaxially fixed to the shaft are a gear 46*b* engaging with a gear 48*a* coaxially connected to the transfer roller 48 and a sprocket 46*c* coupled by means of a chain with a sprocket 45*a* coaxially connected to the drive roller 45 which is the other drive roller of the second transfer path 44. With such a gear connection, when the gear 65 rotates clockwise, the drive rollers 45 and 46 rotate counterclockwise and the transfer roller 48 rotates clockwise.

Three pairs of the transfer rollers 34, 35 and 37 are coupled with the sprocket 61 by means of chain-sprocket connecting means so that the rollers of each pair rotate in opposite directions to transfer the recording paper in the predetermined directions.

As shown in FIG. 4, two print buttons 63 and 64 are provided on the upper surface of the housing 1. When the button 63 is depressed, the transfer rollers 21*a* and 22*a* within the housing are rotated clockwise. At this time, the motor 53 in the auxiliary copying device is also driven, so that the respective rollers in the copying device 31 are rotated in given directions. The depression of the button 63 causes the clutch 59 to be in a disconnected state while causes the clutch 60 to be in a connected state. As a result, the belt 51 in the first transfer path 43 is moved in a direction A in FIG. 5. The director gate 39 has been brought to the position as indicated by the solid line in FIG. 3, by means of the spring 39*a*.

When the button 64 is depressed, the transfer rollers 21*a*, 22*a* are rotated, the motor 53 is driven and further the solenoid 39*b* is energized. As a result, the director gate 39 is turned to the position as indicated by the broken line in FIG. 3, resisting the force of the spring 39*a*, so that the shut-off of the transfer path from the roller pair 34 to the roller pair 35, is removed. At this time, the clutch 59 is in the connected state while the clutch 60 is in the disconnected state. The belt 51 is moved in a direction B in FIG. 5.

The operation of the electrostatic copying apparatus as mentioned above will be described.

After the cassette 22 and the tray 29 are removed from the housing 1, the auxiliary copying device is coupled with the housing 1 so that the second transfer path 44 partially extends into the inside of the housing 1 through the opening into which the cassette 22 removed had been inserted. After a bundle of the recording papers with the same size as the document 4 are set in the cassette 21, a power switch (not shown) is turned on and then the first print button 63 is pressed. Upon the depression of the button 63, the lamp 7 moves along the document 4 by means of the motor 3 to illuminate the document. By the illumination, an image of the document 4 is formed on the light sensitive drum 12 through the first mirror 8, the second mirror 9, the mirror lens 10 and the third mirror 11. An electrostatic latent image formed on the outer periphery of the light sensitive drum 12 is sequentially subjected to the development, transfer and fixing processes as the drum 12 rotates. The recording sheets P1 taken out one by one from the cassette 21 are guided by the guide plate 23 to the light sensitive drum 12 through the roller pair 25. In the transfer charger 15, the image is transferred on one side of the recording paper P1. Then, the recording paper with the transferred image is peeled from the drum 12 after passing through the separation charger 16 and the turn roller 17, and the image on the recording paper is fixed in the fixing device 26. The recording paper P1 after passing the fixing device 26 is transferred into the auxiliary copying device 31 by the rollers 27 and 28. The light sensitive drum 12 after its transfer process is completed is returned to the charger 13 through the charge remover 18, the cleaner 19 and the erasing lamp 20.

Since the director gate 39 is positioned to shut off the transfer path to the transfer roller pair 35, as indicated by the solid line in FIG. 3, the recording paper P1 transferred into the auxiliary housing 32 is guided by the guide plates 41 and 42 to reach the transfer roller pair 37 and then is transferred to the first transfer path 43. At this time, the belt 51 is moving in the direction of the arrow A by the drive roller 50. Accordingly, the paper P1 is transferred into the second tray 38 until the leading end of the paper P1 contacts the end wall 38*a* of the tray 38. In this way, the paper P1 is set in the second tray 38 with the recording surface of the paper facing down. When a plurality of recording papers are continuously copied, the recording papers P1 are successively stacked one upon another in the second tray 38.

When a desired number of the recording papers P1 have been copied on the first side, the document 4 is replaced by another document or it is turned over and the second button is pressed. As a result, the first belt 51 is driven by the drive roller 49 in the direction of the arrow B and transfers the lowermost paper of the stacked papers P1 in the second tray 38 in the direction of the arrow B through clearance provided between the belt 51 and the lower end of the wall 38*b* of the second tray 38. Even if two or three papers stacked are together transferred, the roller 52 rotates counterclockwise, so that only the lowermost paper is separated from the remaining one or ones by means of the roller 52 and ahead the roller 52. The recording paper transferred to the first belt 51 is transferred to the guide plate 24 through the second belt 47 and the transfer roller 20. The transfer paper P1 is then transferred to the light sensitive drum 12 in synchronism with the movement of the light source 7 by means of the roller pair 25 which is controlled by a timing means such as a microswitch. Subsequently, an image is transferred onto the other side of the recording paper P1 and then is transferred to the transfer roller pair 34, through the separator 16, the turn roller 17, the fixing device 26 and the rollers 27 and 28. At this time, the director gate 39 has been turned to the position as indicated by the broken line in FIG. 3 and the recording paper P1 passed through the roller pair 34 is transferred through the roller pair 35 to the first tray 36. The recording papers thus copied on both sides thereof are successively transferred to the first tray 36 and stacked therein.

As described above, in the electrostatic copying apparatus according to the invention, normal one-sided copying may be performed by the main body of the copying apparatus with the main housing. Double-sided copying may be made by coupling the auxiliary copying device having the auxiliary housing with the main copying apparatus, after the first paper supply tray and the exhausted paper tray are removed from the main copying apparatus. Therefore, when only one-sided copying is performed, the main copying machine is set at a proper location separately from the auxiliary copying device. This saves the space for setting the copying apparatus. Further, when the copying apparatus must be carried or moved to another place, the carry or movement may be made separating the auxiliary copying device from the main copying apparatus. This makes it easy to carry or move the copying apparatus.

What we claim is:

1. An electrostatic copying apparatus comprising a main copying device and an auxiliary copying device removably coupled with said main copying device, said main copying device comprising:

first and second paper supply trays holding recording papers;

a main housing having a paper supply opening into which said first paper supply tray is inserted and a paper exhaust opening;

a copying mechanism provided in said main housing for copying an image onto said recording paper;

first and second paper supply means provided in said main housing for selectively supplying the recording papers from said first and second paper supply trays to said copying mechanism; and means provided in said main housing for leading the copied recording paper to said paper exhaust opening, and said auxiliary copying device comprising:

an auxiliary housing which may be removably coupled with said main housing, while said first paper supply tray is separated from said main housing;

first and second auxiliary paper exhaust trays provided in said auxiliary housing;

a selective paper supply mechanism provided in said auxiliary housing for selectively supplying the recording paper, which is supplied from said main housing through said paper exhaust opening to said auxiliary housing, to said first and second auxiliary paper exhaust trays; and a transfer mechanism which cooperates with said first paper supply means for transporting the recording paper from said second auxiliary paper exhaust tray to said copying mechanism through said paper supply opening.

2. An electrostatic copying apparatus according to claim 1, wherein said main housing is provided with a side having said paper supply opening for said first paper supply tray, said paper exhaust opening and another paper supply opening into which said second paper supply tray is inserted.

3. An electrostatic copying apparatus according to claim 2, wherein said paper exhaust opening is formed at the upper part of said side of said main housing, said paper supply opening for said second paper supply tray is at the lower part, and said paper supply opening for said first paper supply tray is at the part between said paper exhaust and paper supply openings.

4. An electrostatic copying apparatus according to claim 3, further comprising a paper exhaust tray removably set into said paper exhaust opening of said main housing.

5. An electrostatic copying apparatus according to claim 4, wherein said transfer mechanism of said auxiliary copying device partially extends into said main housing through said paper supply opening for said first paper supply tray when said auxiliary housing is coupled with said main housing.

6. An electrostatic copying apparatus according to claim 5, wherein said transfer mechanism has first and second transfer belts arranged in a series; said first transfer belt for transferring the recording paper from said second auxiliary paper exhaust tray to said second transfer belt and said second transfer belt for transferring, in cooperation with said first paper supply means, the recording paper to said copying mechanism.

7. An electrostatic copying apparatus according to claim 6, wherein said first paper supply means includes a paper supply roller rotatable so as to nip and transfer the recording paper between said roller and said second transfer belt.

8. An electrostatic copying apparatus according to claim 7, wherein said transfer mechanism includes a roller which is provided near said first transfer belt and is rotatable in the direction opposite to the rotational direction of said paper supply roller, contacting with the recording paper on said first transfer belt.

* * * * *